US009551217B2

(12) United States Patent
Ries et al.

(10) Patent No.: US 9,551,217 B2
(45) Date of Patent: Jan. 24, 2017

(54) PICK ASSEMBLY, BIT ASSEMBLY AND DEGRADATION TOOL

(71) Applicants: ELEMENT SIX GMBH, Burghaun (DE); ELEMENT SIX ABRASIVES S.A., Luxembourg (LU)

(72) Inventors: Bernd Heinrich Ries, Burghaun (DE); Frank Friedrich Lachmann, Burghaun (DE); Robert Fries, Springs (ZA)

(73) Assignees: Element Six GmbH, Burghaun (DE); Element Six Abrasives S.A., Luxembourg (LU)

( * ) Notice: Subject to any disclaimer, the term of this patent is extended or adjusted under 35 U.S.C. 154(b) by 0 days.

(21) Appl. No.: 14/418,977

(22) PCT Filed: Aug. 29, 2013

(86) PCT No.: PCT/EP2013/067929

§ 371 (c)(1),
(2) Date: Feb. 2, 2015

(87) PCT Pub. No.: WO2014/033227

PCT Pub. Date: Mar. 6, 2014

(65) Prior Publication Data

US 2015/0300166 A1 Oct. 22, 2015

Related U.S. Application Data

(60) Provisional application No. 61/695,497, filed on Aug. 31, 2012.

(30) Foreign Application Priority Data

Aug. 31, 2012 (GB) ..... 1215555.2

(51) Int. Cl.
*E21C 35/19* (2006.01)
*E21C 35/193* (2006.01)
(Continued)

(52) U.S. Cl.
CPC ..... *E21C 35/1933* (2013.01); *E21C 35/183* (2013.01); *E21C 35/19* (2013.01);
(Continued)

(58) Field of Classification Search
CPC .... E21C 35/19; E21C 35/193; E21C 35/1933; E21C 35/197; E21C 35/1936
(Continued)

(56) References Cited

U.S. PATENT DOCUMENTS 3,039,757 A * 6/1962 Barr ..... F16F 1/40 16/86 A
3,519,309 A 7/1970 Engle et al.
(Continued)

FOREIGN PATENT DOCUMENTS

GB 2492646 A 1/2013
WO 2012113707 A2 8/2012

OTHER PUBLICATIONS

International Patent Application No. PCT/EP2013/067929, International Search Report and Written Opinion mailed Aug. 21, 2014, 13 pages.

*Primary Examiner* — John Kreck
*Assistant Examiner* — Michael Goodwin
(74) *Attorney, Agent, or Firm* — Dean W. Russell; Clark F. Weight; Kilpatrick Townsend & Stockton LLP

(57) ABSTRACT

A pick assembly is provided, comprising a bit assembly and a holder assembly; the bit assembly comprising a bit support body, a fastener mechanism and a deflectable member, cooperatively configured such the deflectable member can be deflected responsive to the progressive coupling of the bit support body to the fastener mechanism. The holder assembly comprises a holder body and is configured for accommodating and retaining the bit assembly by interference means. The holder assembly and bit assembly are coopera-
(Continued)

tively configured such that the retention of the bit assembly by the holder assembly by interference means can be progressively increased responsive to the progressive coupling of the bit support body with the fastener mechanism when the bit assembly is accommodated by the holder assembly, operative to prevent substantial movement of the bit support body relative to the holder body in use.

20 Claims, 7 Drawing Sheets

(51) Int. Cl.
*E21C 35/197* (2006.01)
*E21C 35/183* (2006.01)
*E21C 35/18* (2006.01)

(52) U.S. Cl.
CPC .... *E21C 35/197* (2013.01); *E21C 2035/1806* (2013.01); *E21C 2035/191* (2013.01)

(58) Field of Classification Search
USPC ..... 299/106, 107, 110, 111
See application file for complete search history.

(56) References Cited

U.S. PATENT DOCUMENTS 3,752,515 A 8/1973 Oaks et al.
3,767,266 A 10/1973 Krekeler
3,865,437 A 2/1975 Crosby
3,980,325 A 9/1976 Robertson
4,084,856 A 4/1978 Emmerich et al.
4,299,424 A 11/1981 Lebegue et al.
4,323,727 A 4/1982 Berg
4,583,786 A 4/1986 Thorpe et al.
4,609,227 A * 9/1986 Wild ..... E21C 35/18 299/103
5,318,351 A 6/1994 Walker
5,322,351 A * 6/1994 Lent ..... E21C 35/193 299/102
5,992,405 A 11/1999 Sollami
6,220,671 B1 * 4/2001 Montgomery, Jr. .... E21C 35/19 299/102
7,343,947 B1 3/2008 Sollami
7,992,944 B2 8/2011 Hall et al.
8,028,774 B2 10/2011 Hall et al.
8,136,887 B2 3/2012 Hall et al.
2002/0096369 A1 * 7/2002 Glowka ..... E21B 10/633 175/426
2005/0150666 A1 * 7/2005 Holl ..... E21C 35/193 172/1
2008/0030065 A1 2/2008 Frear
2008/0088172 A1 * 4/2008 Hall ..... E21C 35/183 299/39.8
2010/0181820 A1 * 7/2010 Latham ..... B28D 1/188 299/111
2010/0194176 A1 8/2010 Lucek et al.

* cited by examiner

PICK ASSEMBLY, BIT ASSEMBLY AND DEGRADATION TOOL

CROSS REFERENCE TO RELATED APPLICATIONS

This application is the U.S. national phase of International Application No. PCT/EP2013/067929 filed on Aug. 29, 2013, and published in English on Mar. 6, 2014 as International Publication No. WO 2014/033227 A2, which application claims priority to Great Britain Patent Application No. 1215555.2 filed on Aug. 31, 2012 and U.S. Provisional Application No. 61/695,497 filed on Aug. 31, 2012, the contents of all of which are incorporated herein by reference.

This disclosure relates generally to a pick assembly, a bit assembly for same and degradation tool comprising same, particularly but not exclusively for use in mining or road milling.

Degradation tools for breaking up bodies or formations in mining and road milling may comprise pick tools, in which a point of a pick is driven against the body or formation. Some degradation tools comprise a pick element that is mounted onto a driver apparatus such that the pick element is capable of rotating about its axis within a holder in use. Such arrangements may have the effect of reducing the rate of deterioration of the sharpness of the pick element in use due to a more uniform circumferential distribution of the wear of the pick element, thus preventing the pick element from becoming flat on one side. For example, pick elements may comprise a shank having an annular groove in which is mounted a split-type keeper ring that is held captive on the shank. The keeper ring may be formed with projections which are received in recesses in the body which opens into the bore to hold the bit member in the supporting body. Examples of keeper rings are disclosed in U.S. Pat. Nos. 3,519,309; 3,752,515; and 3,767,266.

U.S. Pat. No. 3,865,437 discloses a pick style bit rotationally mounted in the bore of a block, the bit having a shank extending through bore, in which the shank is spilt and comprises a plurality of legs. A rearward end of shank is formed with one or more radial projections. When the bit is fully inserted into the bore of the block, the legs of the shank will spring outwardly and the radial projections will thereafter prevent the bit from being dislodged from the block. The bit can be removed from the block by driving the bit forwardly.

U.S. Pat. No. 4,084,856 discloses a tool element having an insertion end which is made of resilient material which is slotted so that it will move inwardly within the elastic limit of the material during insertion or removal and provide interlocking retention which will permit rotation of the tool element. Insertion and removal may be accomplished by simply knocking the tool element in or out.

U.S. Pat. No. 4,583,786 relates to a mining pick comprising a pick holder in which a pick element is retained, a retaining means allowing the pick to be manually released from the holder for servicing or replacement. A shank of the pick element may be received in a complementary socket in the holder and the retaining means may comprise a spring or loaded pin arranged to be released to permit removal of the pick.

Some degradation tools comprise a pick element that is mounted onto a driver apparatus such that the pick element is prevented from rotating about its axis within a holder in use. Various example arrangements of non-rotationally mounted pick elements are briefly mentioned below.

United States patent application publication number 20100194176 discloses a non-rotating mining cutter pick comprising a shank portion with a non-circular cross-section, a head portion including a tip region distal from the shank portion, a shoulder portion separating the shank portion from the head portion, and a cutting insert comprising super-hard material is mounted at a front end of the tip region.

U.S. Pat. No. 7,992,944 discloses a tool assembly comprising a rotary portion, a stationary portion and a compressible element located between them. The compressible element is compressed sufficiently to restrict or prevent free rotation during a degradation operation.

U.S. Pat. No. 8,028,774 discloses a high impact resistant tool comprising super-hard material bonded to a cemented metal carbide substrate at a non-planar interface. The tool may comprise a threaded shank and a body, the shank capable of being attached to a driving mechanism comprising complementary threading.

U.S. Pat. No. 8,136,887 discloses a high impact resistant tool comprising super-hard material bonded to a cemented carbide substrate. The cemented carbide substrate is bonded to a front end of a cemented carbide segment comprising a stem that is press fit into a bore of a steel body, which is rotationally fixed to a rotatable drum adapted to rotate about an axis.

There is a need for degradation tools comprising pick assemblies that are relatively easy and quick to assemble for use and disassemble for replacement or repair, particularly but not exclusively for degradation tools comprising a super-hard strike tip attached to a holder on-moveable relative to the holder.

Viewed from a first aspect, there is provided a pick assembly comprising a bit assembly and a holder assembly; the bit assembly comprising a bit support body and a fastener mechanism, the fastener mechanism and the bit support body being cooperatively configured such that the fastener mechanism can be progressively coupled to the bit support body; the holder assembly comprising a holder body and configured for accommodating and retaining the bit assembly by interference means; the holder assembly and bit assembly being cooperatively configured such that the retention effect of the interference means (e.g. the force with which movement of the bit support body relative to the holder body can be opposed, for example by friction) can be progressively increased responsive to the progressive coupling of the bit support body with the fastener mechanism when the bit assembly is accommodated by the holder assembly, operative to prevent substantial movement of the bit support body relative to the holder body in use.

In some examples, there can be provided a pick assembly comprising a bit assembly and a holder assembly; the bit assembly comprising a bit support body, a fastener mechanism and a deflectable member, and being cooperatively configured such the deflectable member can be deflected responsive to the (progressive) coupling of the bit support body to the fastener mechanism; the holder assembly comprising a holder body and being configured for accommodating and retaining the bit assembly by interference means, such as friction or inter-engaging mechanical mechanism; the holder assembly and bit assembly being cooperatively configured such that the retention of the bit assembly by the holder assembly by interference means can be progressively increased responsive to the progressive coupling of the bit support body with the fastener mechanism when the bit assembly is accommodated by the holder assembly, operative to prevent substantial movement of the bit support body relative to the holder body in use.

In various example arrangements, "progressively coupled" (of the fastener mechanism to the bit support body, or equivalently, vice versa) may be expressed as "increasingly tightly coupled", "increasingly securely coupled", "increasingly closely (or proximately) coupled" or "coupled in any of a plurality of continuously variable configurations", for example (by grammatical inference, the phrase "progressive coupling" may be expressed as may be expressed as "increasingly tight coupling", "increasingly secure coupling", "increasingly close—or proximate"—coupling", or "coupling in any of a plurality of continuously variable configurations"). An example of progressive coupling as used herein may be the coupling of a nut to a cooperatively threaded member of a bolt, in which the nut can be urged to move continuously along the threaded member by continuously rotating the former about the latter.

Various arrangements and combinations are envisaged by this disclosure for pick assemblies, bit assemblies and tools comprising same. Non-limiting and non-exhaustive examples of with are provided below.

In some example arrangements, the holder assembly may be configured operative to oppose deflection of the deflectable member and increase the effect of the interference means responsive to the coupling of the bit support body to the fastener mechanism when the bit assembly is accommodated by the holder assembly.

The effect of the interference means may be capable of being increased progressively, responsive to the deflectable member being urged against a part of the holder assembly. In some example arrangements, the deflectable member may be viewed as being progressively squeezed between a part of the holder assembly and a part of the bit assembly.

In some example arrangements, the bit assembly may comprise a bit member (for striking a body to be degraded); the bit support body and the bit member being cooperatively configured such that the bit member can be coupled to the bit support body and prevented from moving (e.g. rotating) relative to the bit support body in use.

In some example arrangements, the bit member may comprise a strike tip joined (for example, by braze means) to a bit base. The strike tip may comprise super-hard material such as polycrystalline diamond (PCD) material. The strike structure may be joined to a substrate, in which the substrate may comprise cemented carbide material. The bit base may comprise or consist of cemented carbide material, which may be of a different grade than that comprised in the substrate.

In some examples, the bit base may be shrink fit or press fit into a bore provided in the bit support body. For example, the bit base may be mounted within the bore of the bit support body with an interference fit of at least about 0.014 millimetres and at most about 0.048 millimetres.

In some example arrangements, the fastener mechanism may be capable of being progressively uncoupled from the bit support body. The holder assembly and bit assembly may be configured such that the effect of the interference means can be decreased responsive to the progressive uncoupling of the bit support body from the fastener mechanism, operative to release the bit support body.

In some example arrangements, the holder assembly may comprise a bore for accommodating the bit assembly. The holder assembly may comprise a holder body and a sleeve inserted into a bore in the holder body, the sleeve providing a bore for accommodating the bit assembly. In other example arrangements, the holder assembly may comprise a holder body provided with a bore for accommodating the holder assembly without a sleeve interposed between the bit assembly and the holder body.

In some example arrangements, the bit support body may comprise a bit head region and a shaft depending from the bit head region, the holder assembly being configured for accommodating the shaft. The shaft may comprise a fastenable region to a distal end of the shaft, remote from the bit head region; the fastener mechanism and the fastenable region being cooperatively configured such that the fastener mechanism can be coupled to the fastenable region of the shaft. In some example arrangements, the holder assembly may be configured for accommodating the shaft depending from a bit head region.

In some example arrangements, the fastener mechanism and the fastenable region of the shaft may be cooperatively configured such that the fastener mechanism can be progressively coupled to the shaft by rotation of the shaft relative to the fastener mechanism. For example, the fastener mechanism and the fastenable region may comprise cooperative threading. In some examples the fastener mechanism may comprise a nut, and in some examples the fastener mechanism may comprise a washer.

In some example arrangements, the deflectable member may comprise or consist of a collar configured for accommodating at least part of the bit support body, the collar having a tapered inner surface configured cooperatively with a tapered side surface of the bit support body, the deflectable member capable of being urged radially outward responsive to the tapered side surface of the bit support body being urged against the tapered inner surface of the collar responsive to the progressive coupling of the bit support body with the fastener mechanism. In some example arrangements, the tapered side surface of the bit head region may be defined by a shaft depending from a bit head region.

In some example arrangements, the fastener mechanism, bit support body and collar may be cooperatively configured such that the fastener mechanism can be progressively coupled to the fastenable region of the shaft when the shaft is accommodated by the collar, responsive to rotation of the shaft relative to the fastener mechanism; the deflection member comprised in the collar being progressively deflected responsive to the progressive coupling of the bit support body to the fastener mechanism.

In some example arrangements, the bit support body, the collar and fastener mechanism may be configured such that the bit head region at a proximate end of the shaft will be checked by a proximate end of the collar and the fastener mechanism coupled to a fastenable region at a distal end of the shaft will be checked by a distal end of the collar. The bit head region may thus be substantially prevented from entering the bore of the collar or from progressing beyond some point into the bore from the proximate end, and the fastener mechanism may thus be substantially prevented from entering the bore of the collar or from progressing beyond some point into the bore from the distal end.

In some example arrangements, the collar may define a bore extending between opposite open ends, defining a longitudinal axis extending through centres of both open ends. The inner surface of the collar viewed in lateral cross section may describe a circle, regular polygon, such as a square, or other shape. When viewed in longitudinal cross section, the tapered area of the collar and the shaft may describe a straight line, a curve or some other shape.

In some example arrangements, the tapered inner surface of the collar and of the tapered side surface of the bit support body may be disposed at a taper angle with respect to a longitudinal axis of the bit support body. The taper angle may be at least about 5 degrees or at least about 7 degrees. The taper angle may be at most about 12 degrees or at most about 10 degrees. The taper angle may be in the range of about 7 degrees to about 10 degrees. The selection of the taper angle may depend on properties such as the resilience and or compliance of the material used for the collar, and consequently the degree to which the collar would likely deform in use.

In some example arrangements, the fastener mechanism may be configured for accommodating the fastenable region of the bit support body and comprises the deflectable member.

In some example arrangements, the fastener mechanism may comprise a deflector member cooperatively configured with the deflectable member such that when the fastenable region of the shaft is accommodated by the fastener mechanism, the deflectable member can be deflected responsive to the deflector member being urged between the fastenable region and the deflectable member; operative to progressively increase the interference between the bit assembly and the holder assembly responsive to the deflectable member being urged against a part of the holder assembly.

In various example arrangements, the interference means may comprise frictional contact between a part of the bit assembly and a part of the holder assembly, and or the interference means may comprise a mechanical locking means.

In some example arrangements, the bit support body and or the deflectable member may comprise or consist of steel.

Viewed from a second aspect, there is provided a bit assembly for a pick assembly, the bit assembly being according to this disclosure.

Viewed from a third aspect, there is provided a degradation tool comprising a pick assembly or a bit assembly according to this disclosure. In some examples, the degradation tool may be for use in breaking rock formations comprising coal or potash, and in some examples the degradation tool may be for breaking bodies or structures comprising asphalt or concrete. The degradation tool may be a mining apparatus or a road milling apparatus, for example.

Non-limiting example arrangements of constructions will be described below with reference to the accompanying drawings, of which FIG. 1A shows a partly cut away schematic side view of an example pick assembly;

Figure 1A:
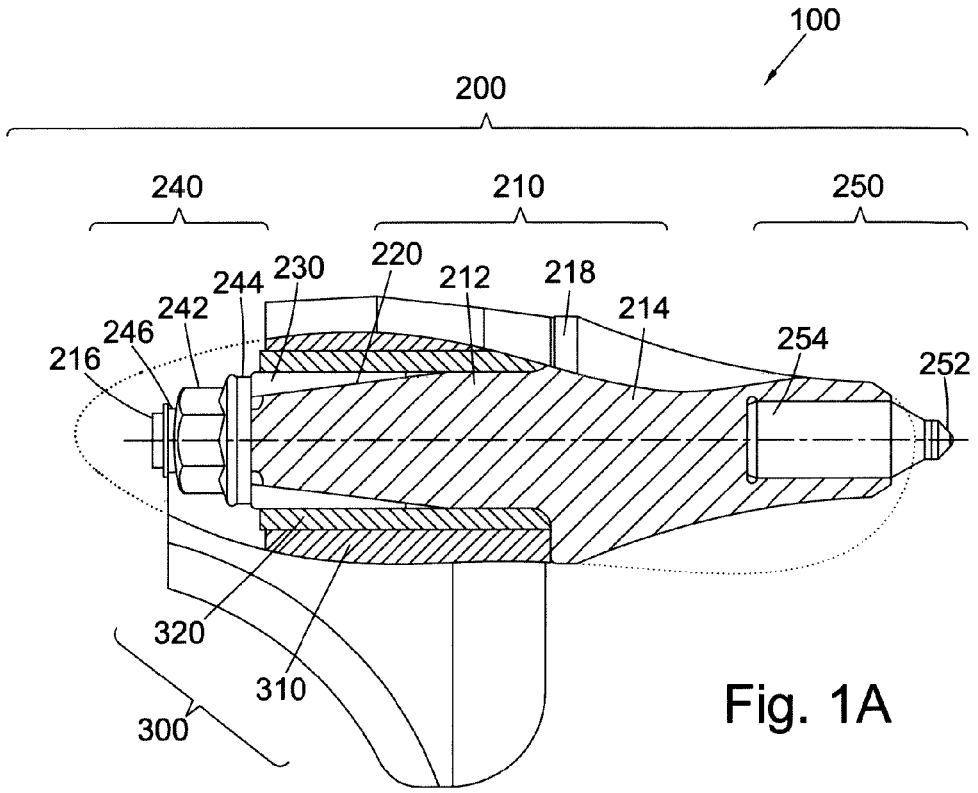
FIG. 1B shows a schematic perspective view of an example pick assembly shown in FIG. 1A.
FIG. 1C and FIG. 1D show schematic longitudinal cross section views through example bit support bodies for the example pick assembly shown in FIG. 1A.
FIG. 1E shows a schematic perspective view of the example bit support body shown in FIG. 1A.
FIG. 1F shows a schematic longitudinal cross section view and a perspective view of an example collar for a bit assembly.
Figure 1B:
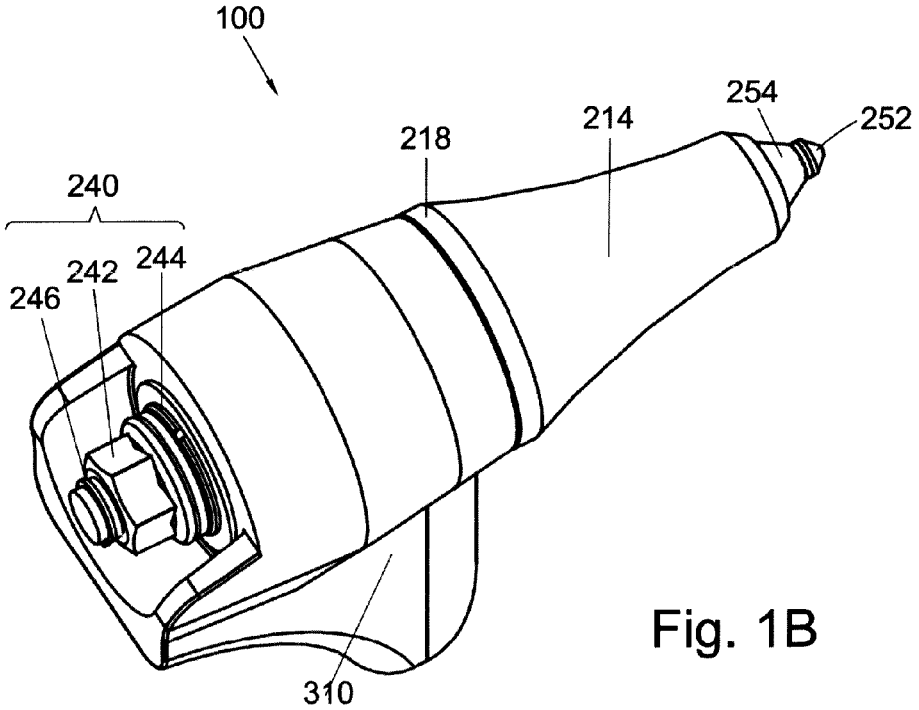
Figure 1C:
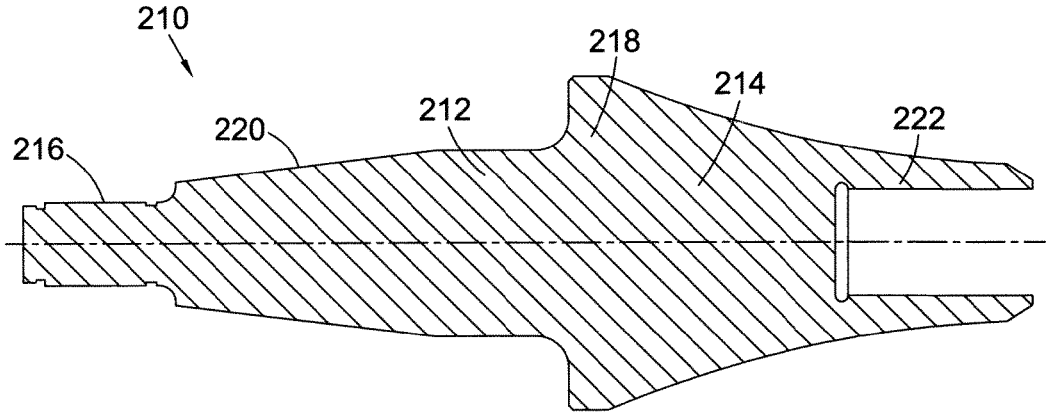

With reference to FIG. 1A to FIG. 1F, an example pick assembly 100 comprises a bit assembly 200 and a holder assembly 300 (which may also be referred to as a "box"). The bit assembly 200 comprises a bit support body 210, a collar 230 (which may also be referred to as a "bush"), a fastener mechanism 240 and a bit member 250. The bit support body 210 comprises a shaft 212 depending from a flange portion 218 of a bit head region 214 and a fastenable region 216 proximate a distal end of the shaft 212 remote from the bit head region 214. The bit head region 214 comprises a bore 222 for accommodating the bit member 250. The holder assembly 300 comprises a holder body 310, which comprises a means (not shown) of attaching the holder to a degradation apparatus (not shown) such as a drum for mining or road milling, and a sleeve 320, the sleeve 320 accommodated by a bore formed in the holder body 310. The sleeve 320 is a generally annular structure having a bore configured for accommodating the bit assembly 200, more particularly a portion of the shaft 212 and the collar 230. The sleeve 230 is press fit into the bore of the holder body 310.

The bit member 250 comprises a strike tip 252 joined to a bit base 254, in which the bit base 254 is accommodated in a bore of the bit support body 250 by means of a shrink fit mechanism. In a particular version of the example, the interference between the bit base 254 and the bore of the bit head region 214 into which it has been shrink fitted may be in the range 0.014 millimetres to 0.048 millimetres. The strike tip 252 comprises a strike structure joined to a substrate. In certain examples, the substrate and the shaft comprise different grades cemented tungsten carbide material and the strike structure comprises polycrystalline diamond (PCD) material.

The diameter of the bore of the sleeve 320 is sufficiently large that the collar 230 can be inserted into it when the collar 230 is not being subjected to a radial force urging the wall of the collar 230 to deflect radially outwards, but sufficiently small that once the collar 230 has been inserted, an outward radial force can urge the outer surface of the collar 230 against the inner surface of the sleeve 320. When the radial outward force is sufficiently large, the collar 230 will be retained within the sleeve 320 by means of a friction interference fit. Subsequent sufficient reduction of the radial force would reduce the interference between the collar 230 and the sleeve.

Figure 1D:
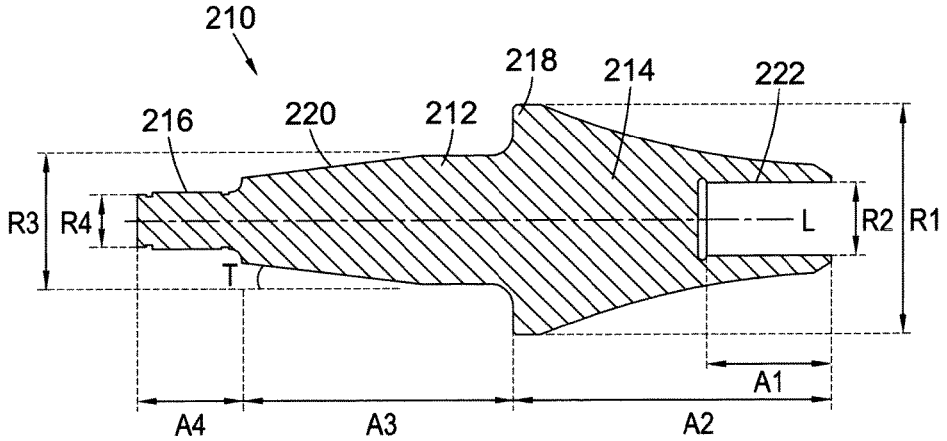
Figure 1E:
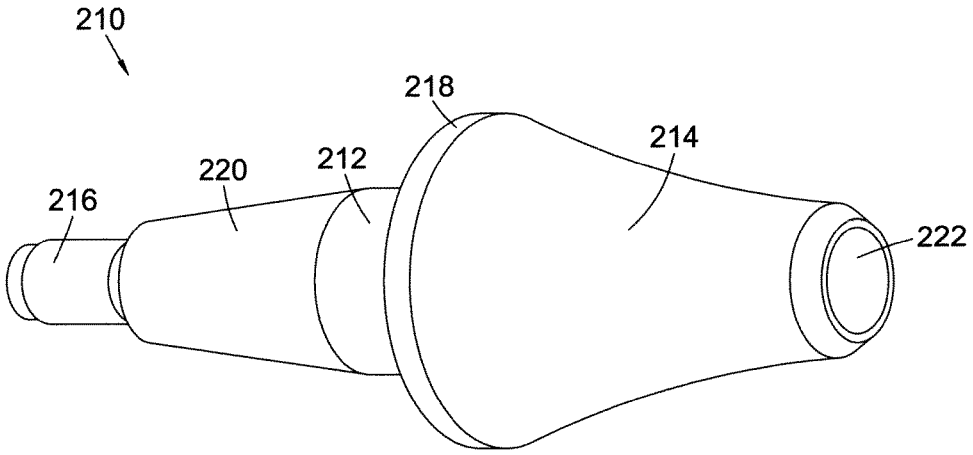

With particular reference to FIG. 1D, the bit support body 214 comprises a flange portion 218 having an outer diameter R1 that is greater than the diameter R3 of the proximate end of the shaft 212 adjacent the flange portion 218, the inner diameter of the collar, of the sleeve and of the bore of the holder body. The diameter R4 of the fastenable region 216 at the distal end of the shaft 212 is less than that of the proximate end of the shaft 212, a tapered region 220 of the shaft 212 increasing in diameter with distance from the fastenable region 216 of the shaft 216 towards the proximate end. Thus, the bit head region 214 at a proximate end of the shaft 212 will be checked by a proximate end of the collar 230 and the bit head region will be prevented from entering the bore of the collar 230 when the shaft 212 is inserted in to the collar 230. The bit support body 210 includes a bore 222 at its proximate end, having a diameter R2 suitable for accommodating a press fit bit member (not shown in FIG. 10). The tapered region 220 is disposed at a taper angle T in relation to a longitudinal axis L defined by the elongate geometry of the bit support body 210 (in other words, a taper angle T would be defined between a plane tangent to the tapered region 220 and a plane tangent to the cylindrically shaped surface of the shaft 212 at the proximate end of the shaft 212). In this particular example, the taper angle T is in the range of 7 degrees to 10 degrees.

In a particular version of the example bit support body illustrated in FIG. 1D, outer diameter R1 of the flange region 218 of the bit head region 214 may be 80 millimetres and the axial length A2 of the bit head region from the edge of the flange region 218 to the furthest proximate end of the bit head region 214 may be about 110 millimetres. The diameter R2 of the bore 222 for accommodating the bit member (not shown) may be about 37 millimetres and the axial depth A1 of the bore 222 may be 46.5 millimetres. The diameter R3 of the shaft 212 adjacent the flange region 218 may be about 44.5 millimetres and the axial length A3 of the shaft 212 from the flange 218 to the fastenable region 216 may be 94 millimetres. The diameter R4 of the fastenable region 216 may be 18 millimetres and the axial length A4 of the fastenable region 218 may be 36 millimetres. In this version of the example, the taper angle T is 7 degrees.

Figure 1F:
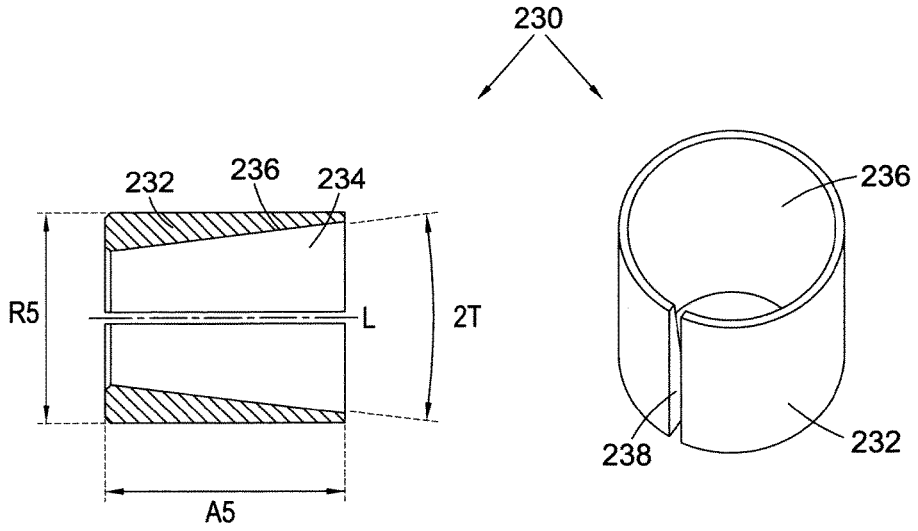

With particular reference to FIG. 1F, the collar 230 comprises a generally annular collar wall 232 defining a bore 234 having a tapered inner surface 236 extending between opposite open ends. The respective tapered surfaces 220, 236 may be conical in shape. Owing to the taper, the collar wall at a proximate end is thinner than the collar wall at a distal end. The tapered inner surface 236 and the tapered surface of the shaft 212 of the bit support body 210 are disposed at substantially the same angle T in relation to the outer side surface of the collar wall 232, which in this example is substantially parallel to the longitudinal axis L, arranged such that when the shaft 212 of the bit support body 210 is inserted into the bore 234 of the collar 230, the respective tapered surfaces 236 and 220 can abut each other. The collar 230 includes an axial gap 238 connecting opposite ends of the collar wall 232, operative to allow the collar wall 232 to be reversibly deflected radially outward responsive to a radially outward force against the inner surface 236 (radial deflection being in relation to a longitudinal axis L passing through the opposite open ends of the collar wall 232). Thus when the shaft 212 of the bit support body 210 is inserted into the bore 236 of the collar 230 such that the respective tapered surfaces 220, 236 abut, the collar wall 232 can be deflected radially outward as the bit support body 210 is progressively urged longitudinally further into the bore of the collar 230. The deflection may not need to be more than a fraction of a millimetre.

In a particular version of the example shown in FIG. 1F, the longitudinal length A5 of the collar wall 232 may be 50 millimetres, its outer diameter R5 may be 44.5 millimetres, the axial gap may be about 3 millimetres and the taper angle T may be 7 degrees (2T may be 14 degrees).

The fastener mechanism 240 comprises an internally threaded nut 242 and a washer 244, and the fastenable region 216 comprises cooperative threading to that of the nut 242 so that the nut 242 can be screwed onto the distal end of the shaft 212. A retainer ring 246 may be attached to the fastenable region 216 such that the nut 242 will be prevented from being accidentally detached from the shaft 212. The taper on the bore surface of the collar and the surface 220 of the shaft 212 is such that the cross sectional diameter of the shaft 212 decreases and the diameter of the bore of the collar 230 decreases with axial distance from the bit head region 214. In this example, the bore of the collar 230 and the shaft 212 of the bit support body 210 are circular. The washer 244 has a sufficiently large diameter that it will abut a distal end of the collar 230 when the nut 242 is screwed onto the fastenable region 216 inserted in the collar 230. In this particular example, the diameter of the washer 244 is not so large that it exceeds the outer diameter of the collar 230. This arrangement will ensure that the nut 242 will be prevented from entering the distal end of the bore of the collar 230. The bit support body 210, washer 244, collar 230 and sleeve 320 are configured such that the washer 244 will not substantially abut the distal end of the sleeve 320 when the nut 242 is sufficiently tightened against the washer 244, and consequently the washer 244 against the collar 230, such that the bit assembly 200 is securely and non-rotatably held within the holder assembly 300 as in use. This arrangement is likely to reduce stresses within the holder assembly 300 arising from the bit assembly being securely held as in use.

The bit support body 214, fastener mechanism 240 and the collar 230 are cooperatively configured such that the collar 230 can be deflected radially responsive to the screwing the nut 242 onto the fastenable region 216 of the shaft 212. When the bit support body 210 is inserted into the collar 230 such that the tapered surface 220 of the shaft 212 contacts the tapered inner surface 220 of the bore of the collar 230, the nut 242 screwed onto the fastenable region 216 of the shaft 212 with the washer 244 located between the nut 242 and the distal end of the collar 230, the nut 242 can be progressively tightened against the washer 244 and consequently against the distal end of the collar 230. Progressive tightening of the nut 242 will begin to urge the tapered surface 220 of the shaft 212 against the inner surface of the collar 230 bore, causing the collar wall 232 to be deflected radially outwards as the shaft 212 is urged longitudinally further into the bore.

When the bit assembly 200 is inserted into the holder assembly 300, radially outward deflection will be checked by the sleeve 320 and consequently the bore of the holder body 310. The bit assembly 200 may be provided in loosely assembled form, in which the nut 242 is screwed onto the shaft 212 to some extent, but not sufficiently tightly to urge the tapered surface 220 of the shaft 212 against the tapered surface 236 of the bore with sufficient force to result in the outward radial deflection of the collar wall 232 of the collar 230. In this arrangement, it will be possible to insert the bit assembly 200 including the collar 230 into the bore of the sleeve 320. Once the collar 230 is longitudinally positioned within the sleeve 320 for use, the nut 242 may be screwed onto the end of the shaft 212 progressive tightening of the nut 242 and urging the respective tapered surfaces 220, 236 against each other, thus applying a radially outward force against the inner surface 236 of the collar wall 232. Radially outward deflection of the collar wall 232 will be checked by the sleeve 320, giving rise to an opposing reaction force on the collar wall 232. Progressive tightening of the nut 242 will result in increasing radial force and consequently increasing interference between the sleeve 320 and the collar wall 232, until the interference is sufficient for the bit support body 214 to be prevented from rotation relative to the holder body 310 or other unintended movement relative to the holder body 310 in use. In some example arrangements, the fastening mechanism 240 may be configured such that it is possible to tighten the nut 242 by rotating the bit support body 212, the nut 242 being prevented or retarded from rotating with the bit support body 212.

In use, the pick assembly 100 will be driven against a body to be degraded, the strike structure 252 at the furthest proximate end (as well as other parts of the bit assembly 100 near the strike structure 252) being caused to strike the body.

Examples of bodies that may be degraded using disclosed pick assemblies include rock formations, which may comprise coal or potash, and pavements or roads comprising asphalt or concrete. A plurality of pick assemblies 100 (in assembled form) may be mounted onto a drivable apparatus (not shown) such as a drum or belt.

When it is desired to remove the bit assembly 200 from the holder assembly 300, for example to replace it or a part of it, the nut an be unscrewed to loosen the bit support body 212 sufficiently for the intermediate body 230 to relax radially and permit the bit assembly 200 to be removed.

In another example, the holder assembly may not comprise a sleeve for accommodating the collar, which may directly abut the surface of a bore provided in the holder body.

Figure 2:
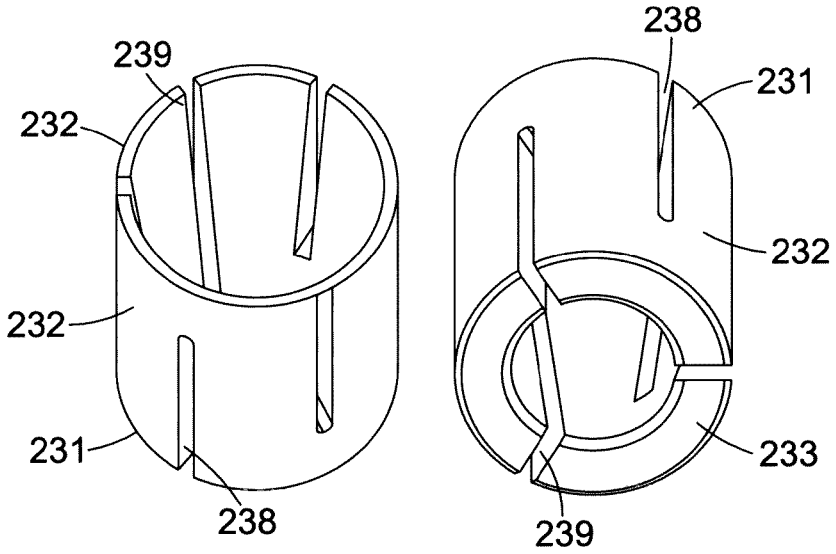
FIG. 2 shows two schematic perspective views of an example collar for a bit assembly.

With reference to FIG. 2, the collar 230 comprises a generally annular collar wall 232 defining a bore 234 having a tapered inner surface 236 extending between opposite open ends. Owing to the taper, the collar wall at a proximate end is thinner than the collar wall at a distal end. The tapered inner surface 236 and the tapered surface of the shaft 212 of the bit support body 210 are disposed at substantially the same angle T in relation to the outer side surface of the collar wall 232, which in this example is substantially parallel to the longitudinal axis L, arranged such that when the shaft 212 of the bit support body 210 is inserted into the bore 234 of the collar 230, the respective tapered surfaces 236 and 220 can abut each other. The collar 230 includes two pairs of three axial gaps 238, 239 (in other examples the number of axial gaps may be different), each of the gaps 238, 239 extending from an end of the collar wall 232 to an axial distance from the end, but not all the way to the opposite end. In this particular example, three of the gaps 238 extend from the proximate end of the collar wall 232 and three gaps 239 extend from the distal end, the gaps in each pair being interposed between each other. The gaps 238, 239 are configured to allow the collar wall 232 to be reversibly deflected radially outward responsive to a radially outward force against the inner surface 236.

With reference to FIG. 3A to FIG. 3E, an example pick assembly 400 comprises a bit assembly 500 and a holder assembly 300. The bit assembly 500 comprises a bit support body 510, a fastener mechanism 560 and a bit member 250, which may be as described with reference to FIG. 1A. The bit support body 510 comprises a shaft 512 depending from a bit head region 518 and a fastenable region 516 proximate a distal end of the shaft 512 remote from the bit head region 514. The bit head region 514 comprises a flange portion 518 and a bore 522 for accommodating the bit member 250. The holder assembly 300 comprises a holder body 310, which comprises a means (not shown) of attaching the holder to a degradation apparatus (not shown) such as a drum for mining or road milling, and a sleeve 320, the sleeve 320 accommodated by a bore formed in the holder body 310. The sleeve 320 is a generally annular structure having a bore configured for accommodating the bit assembly 310, more particularly a portion of the shaft 512 and a collar 562 comprised in the fastening mechanism 560.

Figure 3A:
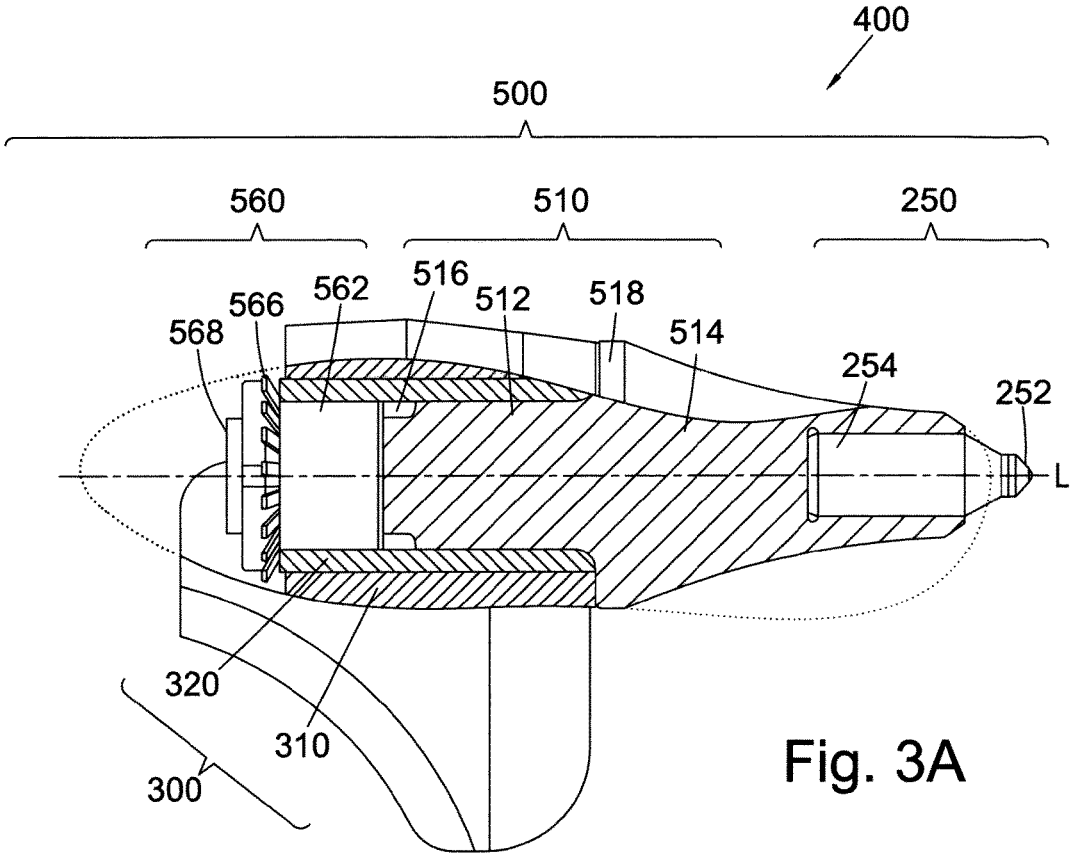
FIG. 3A shows a partly cut away schematic side view of an example pick assembly.
Figure 3B:
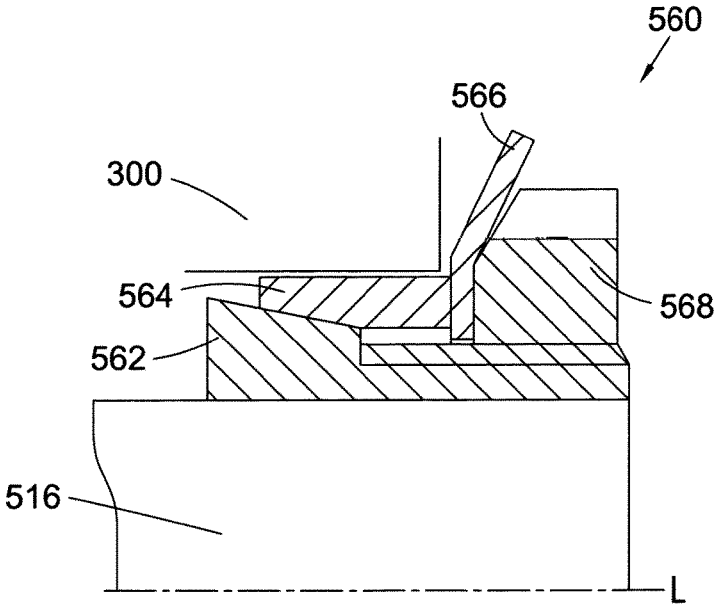
FIG. 3B shows a schematic cross section view of a example fastener mechanism for a pick assembly.
Figure 3C:
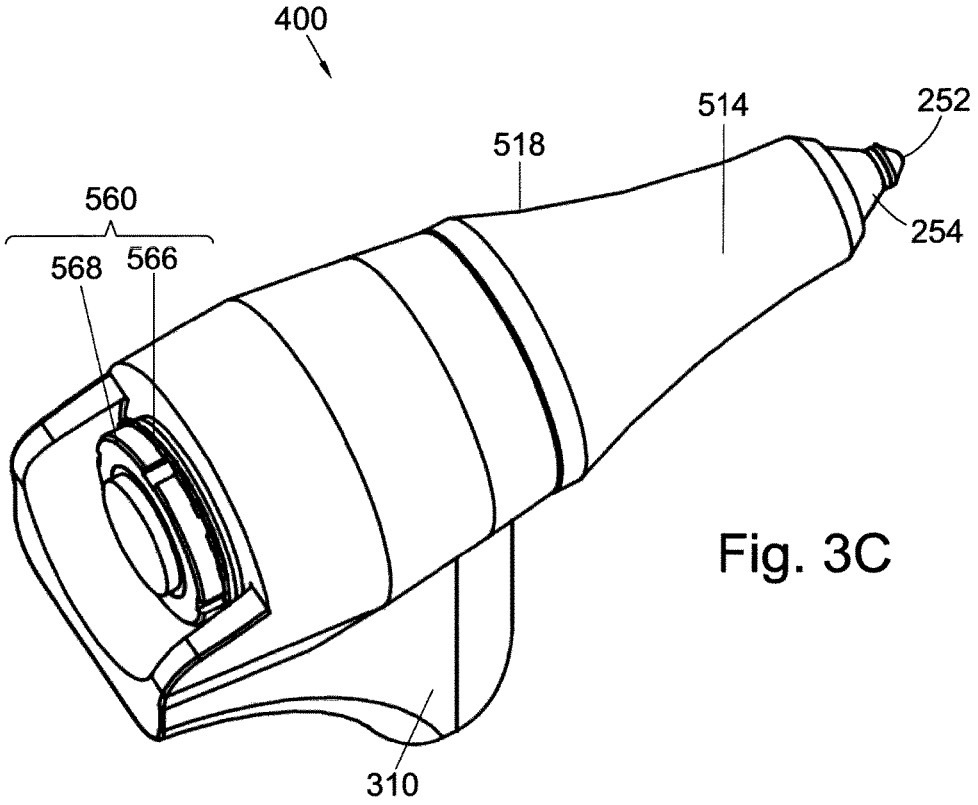
FIG. 3C shows a schematic perspective view of an example pick assembly shown in FIG. 3A.
Figure 3D:
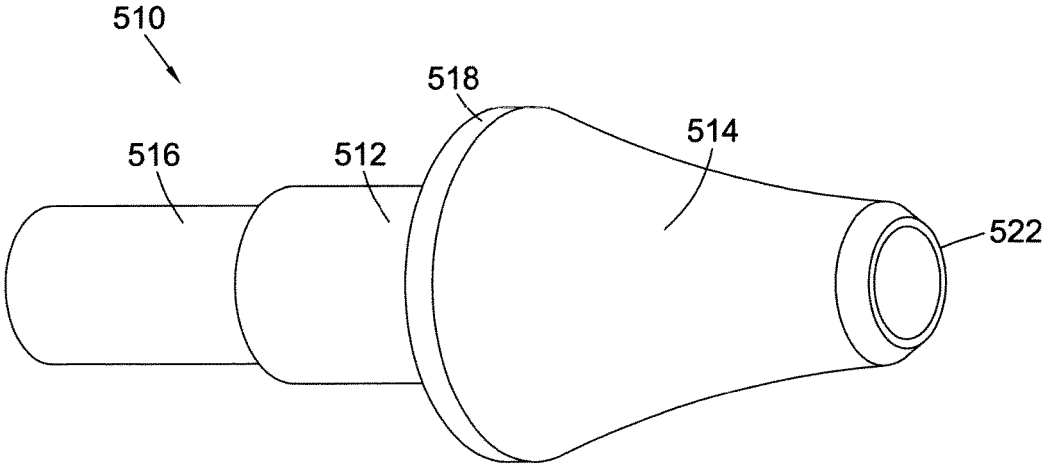
FIG. 3D shows a schematic perspective view of an example bit support body for a pick assembly.

With particular reference to FIG. 3B, the fastener mechanism 560 comprises an outer collar 564, an inner collar 562, a threaded nut 568 and a locking plate 566. The outer collar 564 has an outer surface which is capable of abutting the inner surface of the bore comprised in the sleeve 320 of the holder assembly 300 in use, and an inner surface including a tapered surface area. The inner collar 562 has an outer surface capable of abutting the side surface of the attachment region 516 of the shaft 512 in use, and an inner surface including a tapered surface area. The respective tapered surfaces of the inner and outer collars 562, 564 may be conical in shape. The inner collar 562 and outer collar 564 are cooperatively configured such the respective tapered surface areas can abut and slide over each other. The inner collar 562 and outer collar 564 are coupled to the nut 568 such that the outer collar 564 can be urged to move longitudinally relative to the inner collar 562, the respective tapered surfaces areas sliding over each other, responsive to rotation of the nut 568. An attachment plate 566 is positioned between the nut 568 and the outer collar 564. Owing to the configuration of the respective tapered surface areas, the inner collar 562 and or the outer collar 564 is capable of being radially deflected responsive the outer collar 664 being urged to slide axially (longitudinally) over the inner collar 562. A fastener mechanism of the general kind described above may be obtained commercially from Ringspann™, for example.

In use, the fastener mechanism 560 may be interposed between the fastenable region 216 of the shaft 212 and the sleeve 320 proximate a distal end of the sleeve 320, such that the outer surface of the inner collar 562 abuts the side surface of the fastenable region 516 of the shaft 512 and the inner surface of the outer collar 564 abuts the inner surface of the sleeve. The tapered surface of the outer collar 564 may be urged axially against the tapered surface of the inner collar 562 by rotation of the nut, thus squeezing parts of both collars 562, 564 between the fastenable region 516 of the shaft 512 and the sleeve, which will oppose radial deflection of the either or both of the collars 562, 564. Progressive fastening of the nut 568 will progressively increase the friction interference between fastenable region 516, the collars 562, 564 and the sleeve, and sufficient fastening will prevent substantial rotation of the bit support body 510 relative to the holder body 310 in use.

In another example, the holder assembly may not comprise a sleeve for accommodating the collar, which may directly abut the surface of a bore provided in the holder body.

Figure 4:
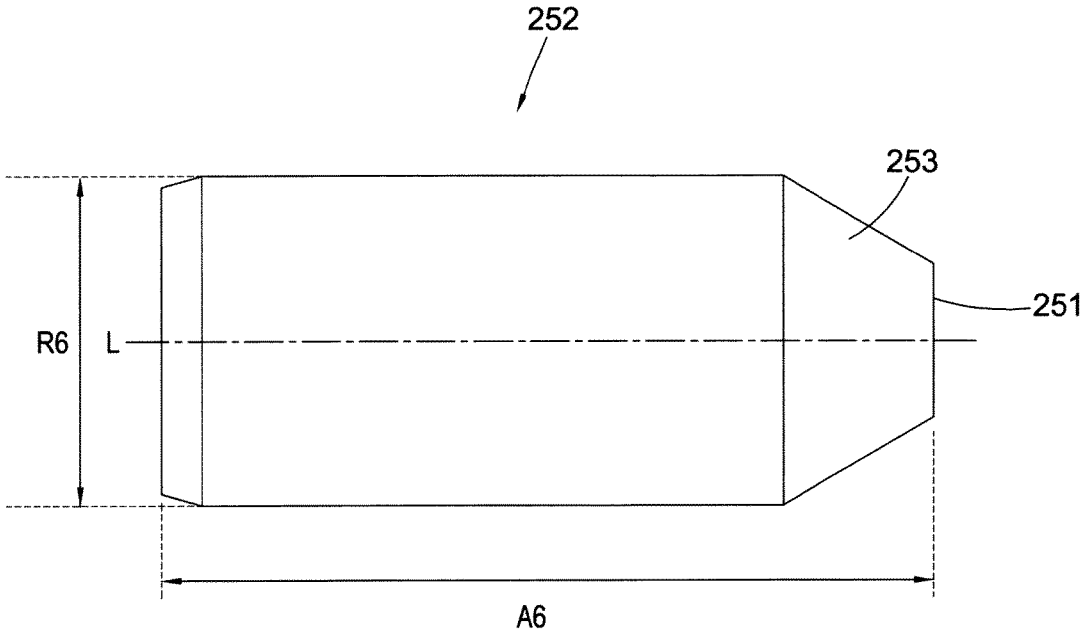
FIG. 4 shows a schematic side view of an example bit base for a bit member.
Figure 5:
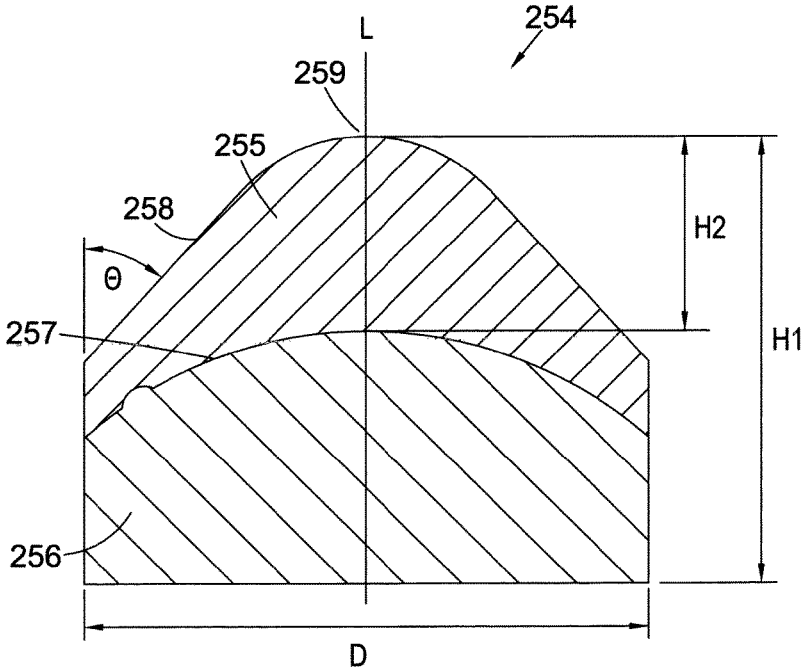
FIG. 5 shows a schematic cross section view of an example strike tip.

With reference to FIG. 4 and FIG. 5, a bit member may comprise a strike tip 254 joined by braze material to a proximate end 251 of a bit base 252 (FIG. 4 and FIG. 5 show the bit base 252 and the strike tip 254, respectively, separately as un-joined parts).

With particular reference to FIG. 4, an example bit base 252 may have a substantially solid cylindrical volume and frusto-conical volume 253, the latter defining the proximate end 251. The length A6 of the bit base 252 may be 58 millimetres and the diameter R6 of the substantially cylindrical volume may be 25 millimetres. The conical surface of the frusto-conical volume 253 may define an internal cone angle of 60 degrees (measured between diametrically opposite sides when viewed in cross section). The bit base may consist of cemented carbide material.

With particular reference to FIG. 5, an example strike tip 254 may comprise a strike structure 255 consisting of polycrystalline diamond (PCD) material, joined at a generally arcuate boundary 257 to a substrate 256 consisting of cemented carbide material. The boundary 257 may be generally dome-shaped. The cemented carbide material comprised in the substrate 256 may comprise a higher content of cobalt cementing material than does the cemented carbide material comprised in the bit base 252. The strike structure 255 defines a strike surface 258 including an apex 259. The strike surface 258 has the general shape of a spherically blunted (rounded) cone, in which the apex defines a radius of curvature in a plane parallel to the longitudinal axis L and a conical area of the strike surface 258 is disposed at an angle θ to the longitudinal axis L. In various versions of the example strike tip 254, the radius of curvature may be in the range 1 millimetre to 4 millimetres and the angle θ may be in the range 30 degrees to 60 degrees.

In arrangements in which the bit member is attached to the bit support body such that it is prevented from moving relative to the latter in use, it will likely be difficult to detach the bit member from the bit support body while the bit assembly is mounted on a degradation apparatus. Detachment of the bit member from the bit support body may require special equipment or heating of the bit support body to release the bit member. Disclosed arrangements of pick assemblies are likely to have the aspect that the bit assembly can be relatively quickly an easily detached from the holder assembly, allowing relatively quick and easy replacement of the bit assembly in the field. The bit member can then be detached from the assembly using special equipment as may be necessary without causing undue delay to degradation operations.

In example arrangements in which the strike tip comprises super-hard material such as PCD, it is likely that the strike tip will wear in use at a substantially lower rate than other components. Consequently, it may not be necessary for the strike tip to be allowed to rotate in use in order to even out the wear over the surface of the strike tip. While wishing not to be bound by a particular theory, this may be due to the very high wear resistance of super-hard materials relative to that of other materials such as steel or cemented carbide material. Certain disclosed arrangements provide a means of mounting a super-hard strike tip onto a holder of a degradation apparatus such that the strike tip will not substantially rotate relative to the holder in use and such that the bit assembly comprising the strike tip can be relatively quickly and easily attached to and detached from the holder in the field, thus likely reducing operational down-time.

Certain terms and concepts as used herein will be briefly discussed below.

As used herein, polycrystalline diamond (PCD) is a super-hard material comprising a mass of diamond grains, a substantial number of which are directly inter-bonded with each other and in which the content of diamond is at least about 80 volume percent of the material. Interstices between the diamond gains may be at least partly filled with a binder material comprising a catalyst for diamond they may be substantially empty. PCD material is manufactured by subjecting an aggregation of diamond grains to an ultra-high pressure and high temperature in the presence of material capable of promoting the inter-growth of the diamond grains (such material being referred to as "catalyst" material for diamond).

Other examples of super-hard material include cubic boron nitride (cBN), polycrystalline cubic boron nitride (PCBN), silicon carbide boded diamond (SCD), and synthetic diamond material made by means of chemical vapour deposition (CVD).

The invention claimed is:

1. A pick assembly comprising a bit assembly and a holder assembly; the bit assembly comprising a bit support body, a fastener mechanism, a deflectable member comprising a collar, and being cooperatively configured such that the deflectable member can be deflected in a radially outward direction responsive to a progressive coupling of the bit support body to the fastener mechanism;

the holder assembly comprising a holder body and being configured for accommodating and retaining the bit assembly by an interference fit;

the holder assembly and bit assembly being cooperatively configured such that the retention of the bit assembly by the holder assembly by the interference fit can be progressively increased responsive to the progressive coupling of the bit support body with the fastener mechanism when the bit assembly is accommodated by the holder assembly, operative to prevent substantial movement of the bit support body relative to the holder body in use; in which the collar is configured for accommodating at least part of the bit support body, the collar having a tapered inner surface configured cooperatively with a tapered side surface of the bit support body, the deflectable member being deflectable in the radially outward direction responsive to the tapered side surface of the bit support body being urged against the tapered inner surface of the collar responsive to the progressive coupling of the bit support body with the fastener mechanism, wherein a gap that extends in an axial direction is formed in a wall of the collar to facilitate in deflection of the deflectable member in the radially outward direction.

2. The pick assembly as claimed in claim 1, in which the holder assembly is configured to oppose deflection of the deflectable member and increase the effect of the interference fit responsive to the coupling of the bit support body to the fastener mechanism when the bit assembly is accommodated by the holder assembly.

3. The pick assembly as claimed in claim 2, in which the bit assembly comprises a bit member; the bit support body and the bit member being cooperatively configured such that the bit member can be coupled to the bit support body and prevented from moving relative to the bit support body in use.

4. The pick assembly as claimed in claim 3, in which the bit member comprises a strike tip joined to a bit base and the strike tip comprises super-hard material.

5. The pick assembly as claimed in claim 1, in which the bit assembly comprises a bit member; the bit support body and the bit member being cooperatively configured such that the bit member can be coupled to the bit support body and prevented from moving relative to the bit support body in use.

6. The pick assembly as claimed in claim 5, in which the bit member comprises a strike tip joined to a bit base.

7. The pick assembly as claimed in claim 6, in which the strike tip comprises super-hard material.

8. The pick assembly as claimed in claim 7, in which the super-hard material is polycrystalline diamond (PCD) material.

9. The pick assembly as claimed in claim 1, in which the fastener mechanism is capable of being progressively uncoupled from the bit support body.

10. The pick assembly as claimed in claim 1, in which the holder assembly and bit assembly are configured such that the effect of the interference fit can be decreased responsive to the progressive uncoupling of the bit support body from the fastener mechanism, operative to release the bit support body.

11. The pick assembly as claimed in claim 1, in which the interference fit comprises friction interference between the holder body and the bit assembly.

12. The pick assembly as claimed in claim 1, in which the holder assembly comprises a sleeve inserted into a bore in the holder body, the sleeve providing a bore for accommodating the bit assembly.

13. The pick assembly as claimed in claim 1, in which the bit assembly comprises a bit head region and a shaft depending from the bit head region, the holder assembly being configured for accommodating the shaft.

14. The pick assembly as claimed in claim 13, in which the shaft comprises a fastenable region proximate a distal end of the shaft, remote from the bit head region; the fastener mechanism and the fastenable region being cooperatively configured such that the fastener mechanism can be coupled to the fastenable region of the shaft.

15. The pick assembly as claimed in claim 1, in which the fastener mechanism and a fastenable region of the shaft are cooperatively configured such that the fastener mechanism can be progressively coupled to the shaft by rotation of the shaft relative to the fastener mechanism.

16. The pick assembly as claimed in claim 1, in which the tapered side surface of the bit support body is defined by a shaft depending from a bit head region.

17. The pick assembly as claimed in claim 1, in which the tapered inner surface of the collar and the tapered side surface of the bit support body are disposed at a taper angle with respect to a longitudinal axis of the bit support body, the taper angle being at least about 5 degrees.

18. The pick assembly as claimed in claim 1, in which the tapered inner surface of the collar and the tapered side surface of the bit support body are disposed at a taper angle with respect to a longitudinal axis of the bit support body, the taper angle being at most about 12 degrees.

19. The pick assembly as claimed in claim 1, in which the fastener mechanism comprises the deflectable member and is configured for accommodating a fastenable region of the bit support body.

20. A degradation tool comprising the pick assembly as claimed in claim 1.

* * * * *